United States Patent [19]

Vincens

[11] 4,114,341

[45] Sep. 19, 1978

[54] COMPOSITE STRUCTURE CONSTITUTED STANDARDIZED ELEMENTS

[75] Inventor: Rene Vincens, 82 A, Route de Geneve, 1028 Preverenges, Switzerland

[73] Assignees: Societe Anonyme pour l'Etude et la Promotion des Entreprises; Rene Vincens, both of Switzerland; part interest to each

[21] Appl. No.: 559,230

[22] Filed: Mar. 17, 1975

[30] Foreign Application Priority Data

| | | | |
|---|---|---|---|
| Mar. 20, 1974 | [FR] | France | 74 09394 |
| Sep. 6, 1974 | [FR] | France | 74 30362 |
| Mar. 13, 1975 | [FR] | France | 75 07902 |

[51] Int. Cl.[2] ..... E04C 2/40

[52] U.S. Cl. ..... 52/580; 52/802

[58] Field of Search ..... 52/284, 731, 730, 619, 52/461, 488, 481, 630, 476, 620, 580

[56] References Cited

U.S. PATENT DOCUMENTS

| | | | |
|---|---|---|---|
| 1,608,672 | 11/1926 | Rappaport | 52/731 |
| 1,853,090 | 4/1932 | Smiley | 52/730 |
| 2,143,288 | 1/1939 | Stolz | 52/481 |
| 2,180,317 | 11/1939 | Davis | 52/630 |
| 2,397,259 | 3/1946 | Halicki et al. | 52/488 |
| 2,697,453 | 12/1954 | Formenti | 52/731 |
| 2,730,210 | 1/1956 | McLaughlin et al. | 52/619 |
| 2,762,398 | 9/1956 | Adam | 52/220 |
| 3,186,131 | 1/1965 | Denny et al. | 52/461 |
| 3,345,790 | 10/1967 | Cornelissen | 52/476 |
| 3,540,116 | 11/1970 | Drahos et al. | 52/619 |
| 3,596,424 | 8/1971 | Ward | 52/619 |
| 3,757,485 | 9/1973 | Vincens | 52/731 |
| 3,813,840 | 6/1974 | Wagenknecht | 52/619 |

FOREIGN PATENT DOCUMENTS

| | | | |
|---|---|---|---|
| 791,124 | 9/1935 | France | 52/579 |

*Primary Examiner*—James L. Ridgill, Jr.

*Attorney, Agent, or Firm*—Robert E. Burns; Emmanuel J. Lobato; Bruce L. Adams

[57] ABSTRACT

A composite structure, formed of construction elements capable of various uses. The elements are associated with one another for the construction of buildings and of fixed and movable fittings, also for use in maintenance, and for other purposes, for example in public works. The composite structure comprises; a primary subassembly which in turn comprises C-section sleeves each having angulate flanges; a supporting and connecting principal beam, having wall faces with longitudinal, mutually opposed retaining cavities, and, to insure the required rigidity of the sub-assembly, transversely bracing and connecting bridges, slid into and engaged with the sleeves and beams at variable spacing between the bridges. Each bridge acts on at least two beams; which have substantially the shape of C, U or omega profiles. The bridges are placed opposite to one another on at least a portion of the length of the internal corners of the retaining flanges of the C-section sleeves. The composite structure also includes a secondary subassembly generally similar to the primary one and connected to the principal beam thereof, by the C-section sleeves.

12 Claims, 10 Drawing Figures

COMPOSITE STRUCTURE CONSTITUTED STANDARDIZED ELEMENTS

BACKGROUND OF THE INVENTION

The present patent has as its subject improvements applied to composite structures.

The composite structures comprise, sub-assemblies which can be associated to form volumes, made starting from profiles of a single type without especially fine tolerance more generally the shape of C-U omegas .

The volumes are thus formed of supporting and connecting structures, and of walls which themselves are supporting and connecting, using bracing bridges capable of making rigid and compact the sub-assemblies and assemblies which are rendered associative with one another.

The present patent constitutes a notable advance on all the earlier patents and in particular on French Pat. Nos. 2109129 - 2138289 - 2188786 - 2196056, by the applicant.

SUMMARY OF THE INVENTION

According to the invention the bridges are characterized: by a greater effectiveness in compression as a result of a capability for orientation of their compressive diaphragms in a number of directions. Compressive diaphragms in earlier bridges have been realised either by crenels and slides, or crenels and tenons etc., the profiles forming the secondary structure and the C-section sleeves.

A secondary structure is generally a principal beam, the bridges of which constitute visible bracing frames capable of being transversely braced and squared by another secondary structure or by one of these constituent elements. Conversely, a double face wall is formed of two principal beams which in the present case are longitudinal, engaged and held on two other principal beams oriented perpendicularly to the first two and disposed at a spacing equal to that between the retaining flanges of the C-sections forming walls.

The wall C-sections are in the present case connected to one another by supporting and interconnecting principal beams which, when used in this manner, are designated secondary beams.

These secondary beams transversely braced by similar ones constitute, by means of their bracing bridges, the internal structure of the wall C-sections.

It follows that the new method and its means enable chains of walls to be realised which are characterized, amongst other things, by wall C-sections: these may be plane or curved depending upon the form of the bracing members, which may be straight, curved or angulate, as a result also of the procedure of folding of the C-sleeves comprising a single retaining flange on at least two opposite sides, self-supporting of great length, as a result of their internal structure and of the transverse folding, which forms at each of their two ends and perpendicularly to the two opposite retaining flanges, at least one retaining flange co-operating with the retaining flanges of the sleeve bridges belonging to the secondary structures, acoustically insulating, as a result of the fact that, not being welded, the internal structure enables any insulating material or material having other properties such as asbestos for example to be blocked against the internal portion of the wall.

The secondary structures form frames, capable of crimping together omegas, for example, and thus of forming I.P.E. structures capable of being extended indefinitely, while the frame structures are, for their part, straight, angulate or curved.

These various aspects of the new composite structures demonstrate the flexibility in use, which is further accentuated by the fact that, there being no welding, it is possible to use the most varied material, and that two or three thin C-sleeves may be superimposed over the whole or a portion of their length.

Moreover, although the method dispenses entirely with welding or gluing, the bridges constitute a perfect means for maintaining compressed together various profiles, which enables gluing to be utilised as an auxiliary means of connection, the bridges ensuring safety and security and fulfilling the function, in this case, of a gluing press.

The bridges interconnect and also square of the components which they join together, as a result of the area and spacing of their compressing and opposed bearing faces.

Finally, as a result of the compression diaphragms which can be oriented to a certain variable, progressive and adjustable extent, the bridges will accept slight tolerances when they are relatively large.

The economic advantage results from the overall aspect of this novel technique applied to assemblies of profiles of a simple type by being braced, interconnected and rendered rigid by a novel connecting means, that is the bridges. This technique is of the class known as "soft technology" by reason of the simplicity of the transformation means utilised. In developed countries, it provides a very important economy in the quantities of materials used: a rigid wall has a weight of 6 kg 700per square metre, inclusive of bridges, while a I.P.E. beam weighs from 15 to 20% less than a steel structure of the same type, and its strength being associated with a deflection coefficient of approximately 18 millimetres, is from 15 to 20% better than that of a traditional steel structure.

The sectorial bridges permit the acoustic and thermal interconnections between two walls to be limited, which walls can be completely isolated from the bridges.

The frames of the bridges enable completely plane surfaces to be obtained, and a certain amount of curvature in the metal sheets to be taken up. The elimination of welding imparts to the assemblies a complete protection against corrosion and enables the whole structure to be made lighter.

The elimination of welding and of surface treatment enables considerable economy to be effected in heat consumption and the polution caused by these treatments to be overcome, and avoid the unhealthy operating conditions for human beings which arise when applying paint coatings.

To summarise, the invention provides an economy in materials, labour, investment and energy.

It enables man and the machine to be reconciled, and production line work to be eliminated as an economic factor.

BRIEF DESCRIPTION OF THE DRAWINGS

A description will be given below, purely as illustrative examples which are in no way limiting, of various forms of embodiment of the invention with reference to the attached sheets of drawings.

In these drawings.

DESCRIPTION OF THE PREFERRED EMBODIMENTS

The improvements applied by the present invention relate more especially to the technology of compressive stiffening bridges which brace composite structures comprising assembled, primary and secondary subassemblies, from the smallest to the largest size, and the modular character of which permits all the combinations of connections to straight or angulate profiles.

Figure 1:
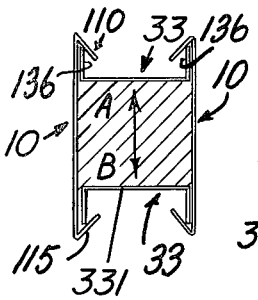
FIG. 1 shows diagrammatically a cross-section of a primary subassembly of the new composite structure.

FIG. 1 schematically shows a primary sub-assembly or principal beams C-sleeves 10, and walls 33. Each sleeve 10 comprises a sleeve 101, bordered longitudinally on each of two opposite sides by a retaining sleeve flange 110 bent towards the most central region of the sleeve and at an acute angle of approximately 45°, as can be seen from FIG. 1. The two sleeves 10 have their generally C-shaped cross-sectional shapes open against one another, and have their flanges 110 slidably edgewise engaging mutually opposite wall flanges 136 of two walls or mutually elementary profiles or walls 33, which block into the corner 115 of the sleeve web 101 and sleeve flanges 110, the walls possess substantially the sectional shape of a U. The blocking of the two elementary profiles 33 inside the sleeves 110 placed face to face is effected by means of bracing bridges not shown in this figure but provided in the shaded area and forming rigid supports which act in the directions A and B, while at the same time forming bearings against each wall; these bridges as provided in accordance with the invention, will be described hereinafter. The principal P.S. forms a subassembly which is compact and rigid. It is capable of resisting the most varied stresses, as a result of the connecting and stiffening bracing bridges. In addition, the retaining flanges 110 constitute effective means for interconnection of P.S. with other beams as each of these flanges constitutes a longitudinal connecting means and forms substantially a jaw. One of the advances achieved here is a combination of bridges, C-section sleeves 10, and elementary profiles 33, permitting extensive composite structure or, true chains of walls to be formed, from primary subassembly P.S. and similar, secondary subassemblies. The composite structures, which can be utilized either for a decorative purpose or for a functional purpose.

Figure 2:
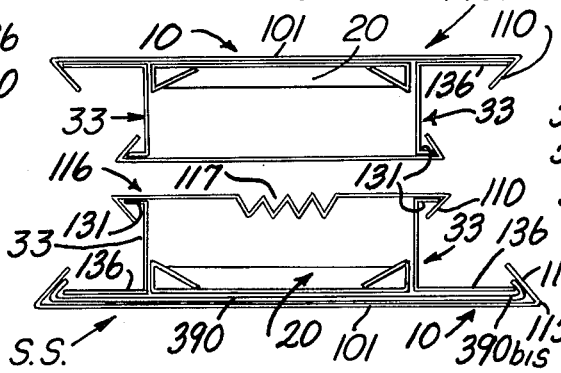
FIG. 2 similarly shows a cross-sectional view of two subassemblies of the new structure.
Figure 3:
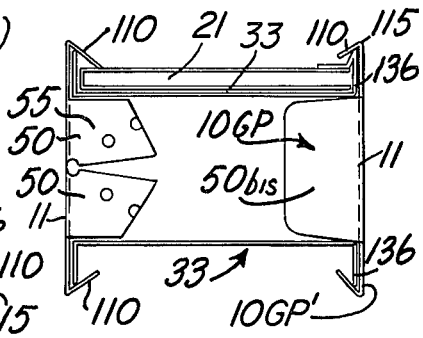
FIG. 3 shows a sectional view of a modification of FIG. 1.

FIG. 2 shows a primary subassembly P.S. located opposite a generally similar secondary sub-assembly SS but not yet connected therewith. Each subassembly has a pair of sleeves 10 and a pair of walls 33, generally as in FIG. 1, and also has a bracing bridge 20 - a rigid member between walls 33 and wall-tying sleeve flange members 110, bracing the subassembly against compressing loads, as will be seen from the illustration. As further shown in FIG. 2, each subassembly has one of its sleeves 116, formed with corrugations or undulations 117 intended for imparting to this section of sleeve a certain degree of elasticity. This C-sleeve 116 comprises two retaining sleeve flanges 110, which engage over retaining wall flanges 131 of the elementary profiles or walls 33 and which are shorter than the wall flanges 136 opposite to them, thus imparting to this sleeve 10 a larger free access, the face-to-face position of the retaining flanges 110 being set back in the lower part of this FIG. 2. The lower C-sleeve 10 barries on its internal face, a cardboard sheet 390, longitudinal edges of which are bent over, 390 bis, and blocked into the internal corner 115 by the wall flange 136 of each of the two elementary profiles 33, themselves blocked by framework bridge 20, which itself thus indirectly blocks two C-sleeves 10 and 390. The sleeves can be made of different materials, but possessing properties complementary one to the other, such as could be the case with a grillage for example, which could constitute, where applicable, a third thickness and form a sandwich. FIG. 3 shows another principal beam, in which the to face walls 33 are blocked by combined C-sleeve bridges carrying orientable compressive diaphragms 50 which constitute retaining and connecting means, the compressive diaphragms forming brackets, as a result of being folded manually or with the assistance of a lever.

The flanges 110 of the C-sleeves 11 also 110 retain a timber board bridge 21 which, at the right side of the figure, is retained through the intermediary of an angle member 10 GP comprising two flanges 10CP angled at approximately 95°. This angle member serves both for decoration and as a connecting means, being retained by one of its two flanges in the internal corner 115 of the C-sleeve.

Figure 4:
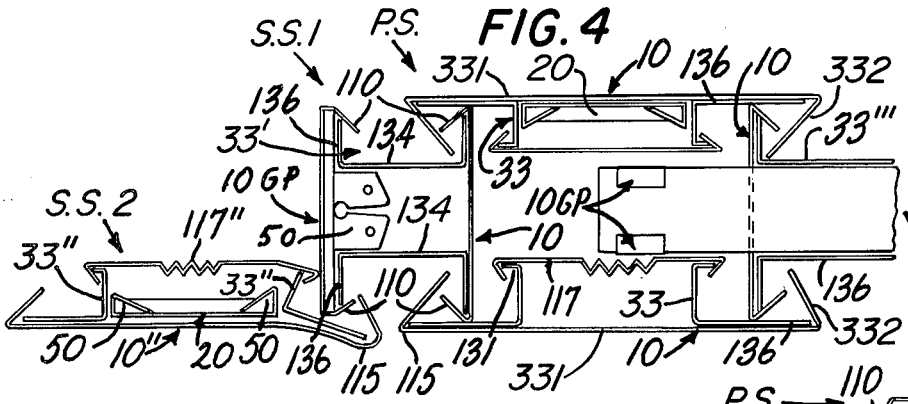
FIG. 4 shows a sectional view of a first embodiment of the invention.

FIG. 4 shows a wall chain or composite structure, comprising from left to right, secondary subcombinations SS2, SS1, principal subcombination PS, and secondary subcombination SS3. As shown, the subcombination SS2 has sleeves 10″, 117″; correspondingly, the secondary subcombination SS-1 has sleeves 10 GP. The primary subcombinations PS is equipped with resilient sleeves 117, which enable the walls or elementary profile S-33 thereof to constitute a hinge facilitating the engagement and disengagement of the opposite sleeve 10, by the sleeve flange 110, with a bridge 10 G.P. of subcombination SS1; the adjacent wall flange 136 of wall 331 of subassembly SS1 constituting, over the entirety of its length, a support means, and the framework bridge 20 in SS1 constituting a reinforcement preventing the C-sleeve 10″ of SS-2 from vibrating, enabling it to be completely plane and to take up, if necessary, the defects in appearance in the curvature of the composite structure.

The two beams providing the principal and secondary subassemblies P.S., SS1 of FIG. 4 constitute two opposite wall faces: one face (left portion) in which the sleeve 106P with its bridge diaphragms 50 is fastened to walls 331 of SS-1, thus constituting an external cladding for a building. In the right part, the principal beam P.S., is equipped internally with a resilient sleeve 117, which enables the diphragms 50 to be locked before engagement; the elasticity of these sleeves permits functioning of the engagement hinge 110, 115, 131 (lower left center of FIG. 4, while constituting a satisfactory support for an internal wall 331, the planeity of which is also assisted by this construction; the sectorial retention constituted by the retaining sleeve flanges 110 engaging in effect the bridges 50 of sleeve 10 G.P. co-operates effectively in the mutual engagement of the subassemblies or principal beams PS SS-1, SS-2, by permitting the engagement pressure to be localised on each of the retaining flanges of short length. The sleeve 10 of principal subcombination PS interconnect the corresponding walls 331, whereby the bridges 20 are blocked after engagement. As shown at the right end of the figure, the composite structure may comprise still further secondary subassemblies SS-3 having walls 33''' connected with the primary subassembly PS by further C-sleeves 10. As still further shown in the lower left part of the figure, the wall flanges 136 on wall web 134 of subcombination SS-1 extend transversely of this wall web to strengthen the wall and to cooperate with wall 33 of the primary subassembly PS. (and also with wall 33'' of the secondary subassembly SS-2) in assembling the entire composite structure, with the help of the respective sleeve flanges 110.

Figure 5B:
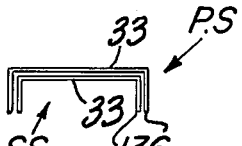
FIG. 5*b* is a modified detail of FIG. 5*a* .
Figure 5A:
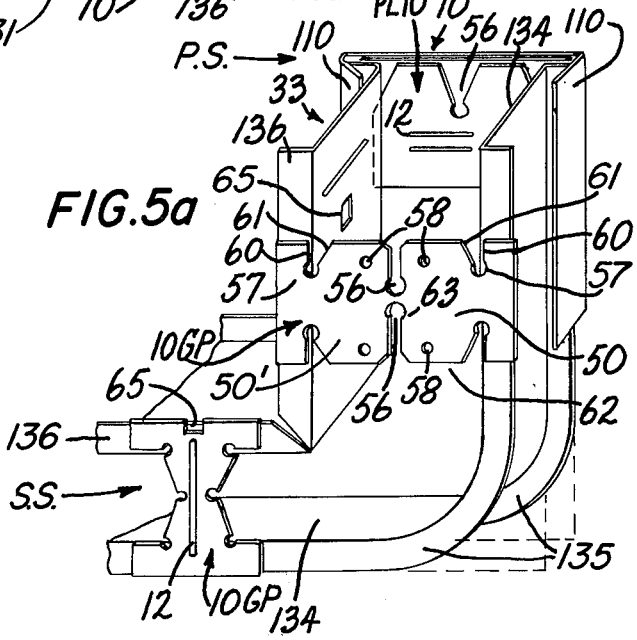
FIG. 5*a* illustrates in perspective a modified composite structure forming part of the invention.
Figure 7:
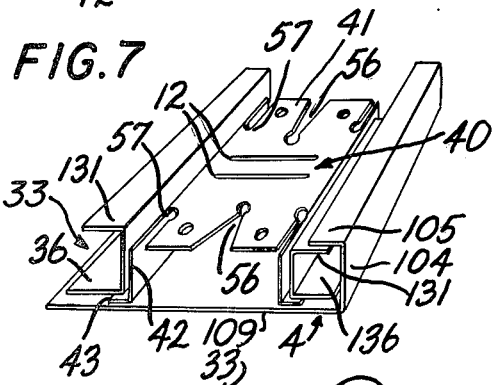
FIG. 7 shows in perspective a modification of FIG. 6.

The wide ranging use of the invention is also demonstrated in FIG. 5, which shows a composite structure formed of two subassemblies PS and SS which are formed to constitute a corner at the lower part of PS. An internal part of this corner is produced suitably cutting the wall flanges 136, and the external part bending the wall 33 to constitute a 90° angle, as shown external of the corner produced by a suitably curved wall 134' with correspondingly curved wall flanges 135. This presentation has been given to demonstrate one of several possible methods of constructing the subassemblies and the resulting composite structure. As shown in FIG. 5*b*, it is also possible to mutually overlap walls 33 of primary and secondary subassemblies. It will be understood that these walls are held together by sleeve flanges 110 (FIGS. 1–5) engaging their wall flanges 136, thereby further assisting the assembling of the entire composite structure. It will also be understood that these walls (FIG. 5*b*) are blocked by bridges 20 (FIGS. 2, 4, 5), which make it possible to impart to the whole assembly a rigid permanent square-bracing of such a nature as to withstand all the stresses associated with their dimensions and thickness of material employed.

In the upper part of FIG. 5, the structure as shown comprises a C-sleeve 10, against the web of which there is slid, or depending upon the dimensions engaged by pivoting, a bridge P.L. 10, the width of which permits it to bear against several mm of the external portion of the wall flanges 136 and to be retained by the external C-sleeve 10, which may, if necessary, extend over the entirety of the length of this structure. Several bridges P.L. 10 are generally provided, although only one of them is shown. They can be disposed at a variable spacing, and can be blocked by means of folding substantially perpendicular to the web of the C-sleeve 10, as will be described. The bridges permit the web 134 of each elementary profile or wall 33 to be transversely square braced. In the secondary structure SS, there are shown bridges 10 G.P., which are held with the aid of additional sleeves 10, not shown, and which comprises first and second change stiffening compressive diaphragms 50.

Symmetrical central perforations 56, the central axis of which is situated on a central line parallel to the retaining flanges 110 and between which the diaphragm 50, 50' are interconnected. Additional perforations 57 are situated adjacent of diaphragm 50, defining an arris 60 each parallel to flanges 110 and an arris 61 which is situated opposite to the arris 60, and makes an angle of approximately 30° with it and rejoins an arris 62 coinciding with the free edge of the diaphragm, this arris 62 continuing at 90° to join the central perforation 56, by an arris 63.

Figure 6:
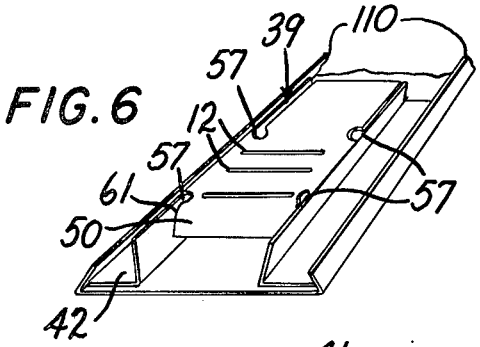
FIG. 6 shows in perspective, a detail of a composite structure according to the invention.
Figure 8:
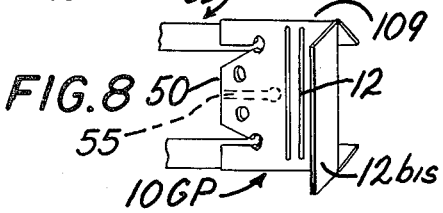
FIG. 8 shows, in a partial front view, a further modification of FIG. 6.

Three stiffening ribs 12 (FIG. 6), desirably swaged in the body of bridge PL 10 or 10 GP are disposed perpendicularly to the retaining flanges 110. It will be noted that the bridge diaphragm 50' of FIG. 6 is more elongate than the diaphragm 50 of FIG. 5, and that it has flange members, designated here by numeral 42, whereby the entire bridge is approximately Omega-shaped in cross-section. A perforation 55, spaced from the arris 63 and 62, permits the introduction of a lever for compressing the web 134 of the elementary profile 33 by forming a loop illustrated in FIG. 8, the diaphragm 50 tending to form its fold along a line joining the perforations 56 and 57. Finally, as shown in FIG. 5, a square perforation 65 is formed astride in one of the wall webs 134, and permitting, if necessary, the retaining flange 136 to be deformed relative to flange 110 to constitute a complementary fixing without adversely affecting the rigidity of this flange, which is firmly held by this bridge.

The compressive diaphragms of the illustrated bridges illustrate a notable advance, which makes them into a connecting means each portion of which constitutes a retaining and blocking means, each compressive diaphragm being applicable to any of the constituent elements of the composite structures in order to co-operate in the stiffening an interconnection of the subassemblies and assemblies.

Partly at two sides by a first perpendicular flange 104, itself extended perpendicularly towards the central portion of the sleve by a flange 105, forming the last retaining flange for an elementary profile or wall 33, one flange 131 of which is in contact with the interior of the flange 105, while its other flange 136 is disposed adjacent sleeve web 109. The sleeve is equipped with a crenel bridge 40 comprising a web 41 extended longitudinally at 90° by a flange 42 of a height substantially equal to that of the two elementary profiles 33 blocked by this bridge. The bridge grips these profiles 33 means of its last flange 43, also continued at 90° towards the exterior from each flange 42, and is blocked beneath the flange 136 of each elementary profile 33 by the compression of web 41 of diaphragm 50 permitted mainly by and adjacent the perforations 56 and 57.

Figure 9:
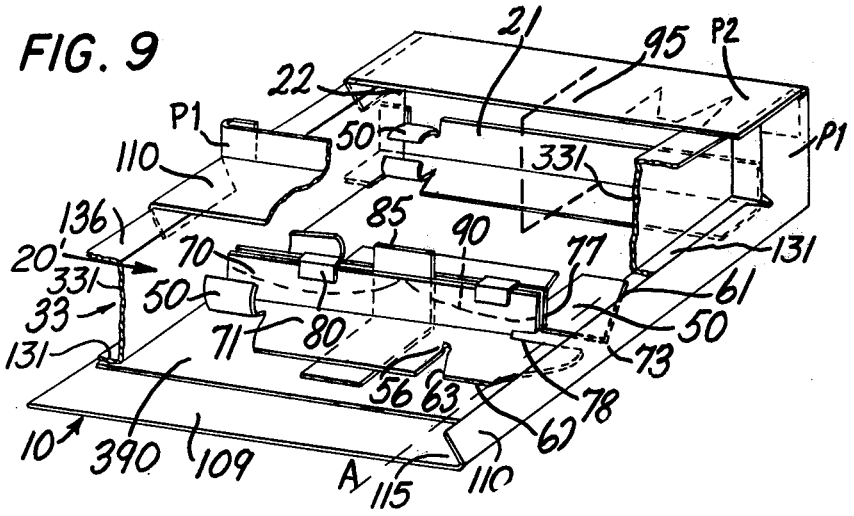
FIG. 9 shows, in a partial perspective view, a further modified composite structure according to the invention.

FIG. 9 shows a part of a composite structure comprising an angularly folded C-sleeve 10, permitting the presence of two elementary profiles blocked in the lower angle by an angle section having four opposite diaphragms, at the top a plate incorporated into the fold and having four opposite diaphragms, and at the first floor a framework bridge blocking an angle member acting as bearing and fixing for a plate.

Each of the two opposite flanges 136 of the two elementary profiles 33 encases a retaining cavity opposite to a flange 110 of the C-sleeve 10, one of these flanges being shown.

This king of beam is useful for the creation of a very large number of types of composite structures, including a simple wall shelf or a cupboard, or a table-top, or a box; these are just some examples amongst others, which make use of parallel folds perpendicular to the flanges 110, whereas numerous applications make use of angle folds, enabling sleeve web areas 109 of trapezoidal shape for example to be produced.

The rigidity and compact character of these assemblies are also obtained by means of bridges known as framework bridges, capable of bracing wide sleeves 10 which require stiffening means extending that of the compressive diaphrams.

FIG. 9 shows a framework bridge 20' comprising two cut brackets 70, 71, each comprising a deep flange portion 70 extended longitudinally at 90° approximately by a bearing flange portion 71, the length of which exceeds that between the wall webs 331 of two elementary profiles 33 which it braces, by projecting at each of its two ends in such a manner as to be capable, as a result of a cut-out of the flange 70, 90 of being slid between the flange 131 of the elementary profile 33 and the web 109 opposite to it; each of the two ends being cut back to the shape of a compressive diaphragm 50, the arris 61 of which, along a fold indicated at the broken line A, compresses the elementary profile 33 in contact, forming a stiffening and compressive square arrangement. The cutting of this arris 61 from the end 73 forms an angle which varies according to the bearing width desired. The deep flange 70 is cut from its top to the folding corner at an angle which here is 90° but which can vary according to the shape and angle of the elementary profiles 33; the distance between the two opposite arrises 77 which mark this cutting is slightly less than that between the two webs 331 of the two elementary profiles 33 facing one another, and in addition at the base of this arris 77 a corridor 78 is formed on the flange 70 so as to facilitate the possible passage of a connecting piece, not shown. Two framework bridge brackets 20' are coupled together one against another by their flanges 70, the flanges 71 being towards the outside.

These two brackets are connected to each other by a clip 80, which is a small U of metal co-operating with symmetrical perforations or by a bearing diaphragm bestriding and forking into the corridor 78. These two frameworks connected to each other, comprise here an angle piece 85 of semi-hard steel designed to form a sectorised support on the web of the C-sleeve and to accentuate the curved shape if necessary.

The shape indicated by broken line 90 designates a cut of the flange 70 as an arc in such a way as to impart, where applicable, to this bracing framework 20', a permanent elasticity which is combined if necessary with the angle pieces 85.

In a corner portion, formed by the plane of sleeve P 1 continuing the C-sleeve 10 at 90°, a framework 21 braces the internal angle of this C-sleeve 10 and, as a result of a diaphragm 50 cut at each of its four ends, enables the two mutually facing elementary profiles 33 to be compressed.

This framework 21 is formed of a bracket, the two flanges of which angled at 90° are here of equal depth and the length of which, like that of the bridge 20', slightly exceeds that between the elementary profiles 33 after they have been blocked. In the upper portion P 2 which continues the plane P 1, the bracing process is substantially the same; the framework 22 in this case is of a length equal to that of the internal portion of the web 109 from one internal corner 115 to the other, and it is folded with the C-sleeves 10. This framework comprises, like the preceding one, four compressive diaphragms 50. The U-shape of the broken line 95 symbolises a U-section of adequate dimensions, which may be inserted, having one of its two flanges encased between the web 109 and the flange of the bracket 22, while the other flange is encased between the web 109 and the flange of the framework 21.

I claim:

1. A composite structure for use in the construction of buildings and of fixtures and appurtenances thereof, comprising, primary and secondary subassemblies interconnected with one another to provide a composite structure, each subassembly having;

a pair of walls each having a cross-sectional shape of a type selected from the shape of an L, a C, a U, and an Omega, each wall comprising, a wall web having two mutually opposite longitudinal edges, and a wall flange on each of the two longitudinal edges, said wall flanges extending transversely of the wall web to strengthen the wall and in effect to extend one of the walls of the other subassembly in the composite structure;

a pair of sleeves each having a generally C-shaped cross-sectional shape with one side thereof open toward the corresponding side of another one of the sleeves, each sleeve comprising a sleeve web having two mutually opposite longitudinal edges and each sleeve having a sleeve flange on each of the longitudinal edges of the sleeve web, each sleeve flange extending transversely of the sleeve at an acute angle to the sleeve web, while extending along and slidably edgewise engaging one of the mutually opposite wall flanges of the respective subassembly so as to enable the sleeves of each pair of sleeves to act as mutually opposite wall-tying members to interconnect walls of the primary and secondary subassemblies and thereby to effect the extending of the walls in the composite structure; and bridge means disposed in the subassembly between the respective pair of walls and the respective mutually opposite wall-tying members of the pair of sleeves for rigidly bracing the subassembly against loads compressive of the bridge means to strengthen the composite structure.

2. A composite structure according to claim 1 in which the ridge means of a subassembly comprises first and second, mutually interconnected, mutually foldable diaphragms slidably engaging, respectively, wall and sleeve portions of the subassembly to interconnect said portions while bracing the subassembly.

3. A composite structure according to claim 1 in which a sleeve of a subassembly has sleeve web portions partly cut from the respective sleeve web and having surface portions slidably engaging surface portions of the respective bridge means to strengthen the subassembly.

4. A composite structure according to claim 1 in which the bridge means comprises a rigid diaphragm having edges bearing against surfaces of the webs of mutually opposite sleeves of the respective subassembly.

5. A composite structure according to claim 1 in which the bridge means comprises a rigid diaphragm having edges bearing against surfaces of mutually opposite walls of the respectively subassembly.

6. A composite structure according to claim 1 in which the bridge means comprises a web perforated to provide interconnected first and second web portions folded relative to one another for engagement, respectively, with first and second wall and sleeve parts of the respective subassembly, to strengthen said subassembly.

7. A composite structure according to claim 1 in which the bridge means comprises a rigid member having edges bearing, respectively, against a surface of the web of one of the sleeves and against a surface of one of the walls of the respective subassembly.

8. A composite structure according to claim 1 in which the web of one of the sleeves is corrugated to impart elasticity to it and thereby to further cooperate in the assembling of the composite structure.

9. A composite structure according to claim 1 in which the sleeve web of one of the wall-tying members is curved to define a cylindrically curved surface of the composite structure.

10. A composite structure according to claim 1, in which the bridge means comprises a diaphragm trnsverse of the sleeves of the respective subassembly, the diaphragm having end portions with flanges thereon extending transversely thereof and which hug mutually facing surfaces of the webs and flanges of said sleeves to strengthen the subassembly.

11. A composite structure according to claim 1 in which the bridge means of a subassembly comprise a bridge structure of substantially Omega-shaped cross-sectional shape having flanges extending outwardly of a central portion of said bridge structure and having a surface slidably engaging surfaces of the sleeve flanges of the respective subassembly to facilitate the strengthening of the composite structure.

12. A composite structure according to claim 1 in which the flanges of the bridge structure also have surfaces slidably engaging surfaces of the wall flanges of the respective subassembly to further promote the strengthening of the composite structure.

* * * * *